United States Patent [19]

Eppinger

[11] Patent Number: 4,974,507

[45] Date of Patent: Dec. 4, 1990

[54] SCREEN PRINTING MACHINE

[75] Inventor: Otto R. Eppinger, Parkdale, Australia

[73] Assignee: Reefdale Pty. Ltd., Braeside, Australia

[21] Appl. No.: 411,365

[22] Filed: Sep. 25, 1989

[30] Foreign Application Priority Data

Sep. 26, 1988 [AU] Australia ..... PJ0609/88
Sep. 11, 1989 [AU] Australia ..... PJ6265/89

[51] Int. Cl.[5] ..... B41F 15/10
[52] U.S. Cl. ..... 101/115
[58] Field of Search ..... 101/115, 126, 128.1, 101/127.1

[56] References Cited

U.S. PATENT DOCUMENTS 2,690,118 9/1954 Schwartz et al. ..... 101/115

FOREIGN PATENT DOCUMENTS 306511 3/1930 United Kingdom ..... 101/115

OTHER PUBLICATIONS

ANTEC, Advertising Brochure, 12 Sheets.

*Primary Examiner*—Clifford D. Crowder
*Attorney, Agent, or Firm*—Fleit, Jacobson, Cohn, Price, Holman & Stern

[57] ABSTRACT

A screen printing machine of the type comprising a multiple armed fixed frame and a multiple armed movable frame mounted to rotate above or below the fixed frame through a series of operative positions or operating stations. Print heads may be operatively connected to the fixed frame and screen platens operatively connected to the movable frame or vice versa. The movable frame can be axially moved towards or away from the fixed frame between a non-print position and a print position so that a printing operation can be effected. In one aspect there is provided a centrally disposed drive for causing axial movement of the movable frame. This drive may include a counter balancing mechanism and a preliminary locating device.

15 Claims, 6 Drawing Sheets

SCREEN PRINTING MACHINE

This invention relates to screen printing machines of the general type which may typically comprise a multiple armed fixed frame and a multiple armed movable frame mounted to rotate above or below the fixed frame through a series of operative positions or operating stations. Print heads may be operatively connected to the fixed frame and screen platens operatively connected to the movable frame or vice versa. In at least some of the operative positions, the movable frame can be axially moved towards or away from the fixed frame between a non-print position and a print position so that a printing operation can be effected.

The present invention is more particularly concerned with the privision of means for causing the axial movement of the movable frame relative to the fixed frame.

In one arrangement currently in use, the axial movement of the movable frame is effected through a plurality of pneumatic cylinders which operate on yokes guided on guide means and which in turn raise a plurality of rods adapted to engage on a thrust plate mounted to the movable frame. This arrangement is mechanically complicated and is prone to binding and can result in an unequal lifting force being applied to one side of the frame as compared to another side.

The present invention seeks to provide an improved manner of axially moving the movable frame relative to the fixed frame in a screen printing machine.

According to one aspect of the present invention there is provided a screen printing machine comprising an upright post having a longitudinal axis, and a hollow generally cylindrical portion, a fixed frame which is fixed relative to said post, said fixed frame including a plurality of arms which extend generally radially with respect to the longitudinal axis of said post, a movable frame mounted for rotational movement about the longitudinal axis of the post and for axial movement in the direction of the longitudinal axis of said post between a print position and a non-print position, drive mean for causing said axial movement of said movable frame, and transmission means operatively connecting said drive means to said movable frame, said transmission means including a connecting rod operatively connected to said drive means and at least partially disposed within said hollow portion of said post, said connecting rod extending generally in the direction of the longitudinal axis of the post, and a support member having support arms which extend generally laterally with respect to the longitudinal axis of the post, said arms extending through openings in the wall of the hollow portion of said post, said arms having support sections operatively connected to said movable frame.

In one form, the drive means may comprise a pneumatic piston/cylinder assembly which is preferably pneumatically operated and which is at least partially disposed within or axially aligned with the hollow portion of the post and operatively connected to the transmission means. In another arrangement, the drive means may comprise an air bag operatively connected to the movable frame and being adapted to be inflated or deflated to cause the actual movement of the movable frame section. The drive means may be located above or below the movable frame and the latter is presently preferred.

According to another aspect of the present invention there is provided a screen printing machine comprising an upright post having a longitudinal axis, a fixed frame which is fixed relative to said post, said fixed frame including a plurality of arms which extend generally radially with respect to the longitudinal axis of said post, a movable frame mounted for rotational movement about the longitudinal axis of the post for axial movement in the direction of the longitudinal axis of said post between a print position and a non-print position, counter balancing means operatively connected to the movable frame and being arranged to provide a counter balancing force to at least part of the weight of the movable frame during said axial movement thereof, said counter balancing means being adapted to maintain a substantially constant counter balancing force during said axial movement of said movable frame and drive means for causing said axial movement of said movable frame.

Preferably the counter balancing means comprises an air bag which is operatively connected to the movable frame and is adapted to inflated or deflated to control the counter balancing force on the movable frame section.

As mentioned in connection with the first aspect of the present invention, post includes a hollow generally cylindrical portion and the air bag is operatively connected to the movable frame by transmission means. The transmission means may include a connecting rod operatively connected to the air bag and at least partially disposed within the hollow portion of the post, the connecting rod extending generally in the direction of the longitudinal axis of the post. The transmission means may further include a support member having support arms which extend generally laterally with respect to the longitudinal axis of the post, these arms extending through openings in the wall of the hollow portion of the post and having a support sections thereon operatively connected to the movable frame.

In this particular form of the invention, the drive means may comprise piston/cylinder assembly which is preferably pneumatically operated and which is at least partially disposed within or axially aligned with the hollow portion of the post and operatively connected to the transmission means. Preferably the drive means is disposed towards one end of the post and the counter balancing means is disposed towards the other end of the post.

In alternative arrangement, the drive means may comprise a pair of fluid controlled fluid powered linear actuators such as for example, pneumatic or hydraulic piston/cylinder assemblies operatively connected to the movable frame and disposed externally of the post but preferably adjacent thereto.

In both aspects of the present invention the support sections of the arms of the transmission means are adapted to engage a thrust bearing which is arranged to support the movable frame.

As above in both aspects of the present invention, the movable frame may be rotatable through a plurality of operating positions in which the movable frame arms are disposed relative to the fixed frame arms such that a printing operation can be effected by axial movement of the movable frame to the print position. The screen printing machine may in accordance with either aspect further include primary stop means for inhibiting axial movement of the movable frame unless it is in one of the operating positions.

The apparatus as described in either of the aspects referred to above, may further include preliminary locating means operable to locate the frames relative to one another prior to axial movement of the movable frame.

According to yet another aspect of the present invention there is provided a screen printing machine comprising an upright post having a longitudinal axis, a fixed frame which is fixed relative to said post, said fixed frame including a plurality of arms which extend generally radially with respect to the longitudinal axis of said post, and a movable frame mounted for rotational movement about the longitudinal axis of the post and for axial movement in the direction of the longitudinal axis of said post between a print position and a non-print position, said movable frame being rotatable through a plurality of operating positions in which the movable frame arms are disposed relative to the fixed frame arms such that a printing operation can be effected as a result of axial movement of the movable frame to said print position, the screen printing machine further including preliminary locating means operable to locate the frames relative to one another prior to axial movement of the movable frame.

Preferred embodiments of a screen printing machine in accordance with this invention will now be described with reference to the accompanying invention in which.

Figure 1:
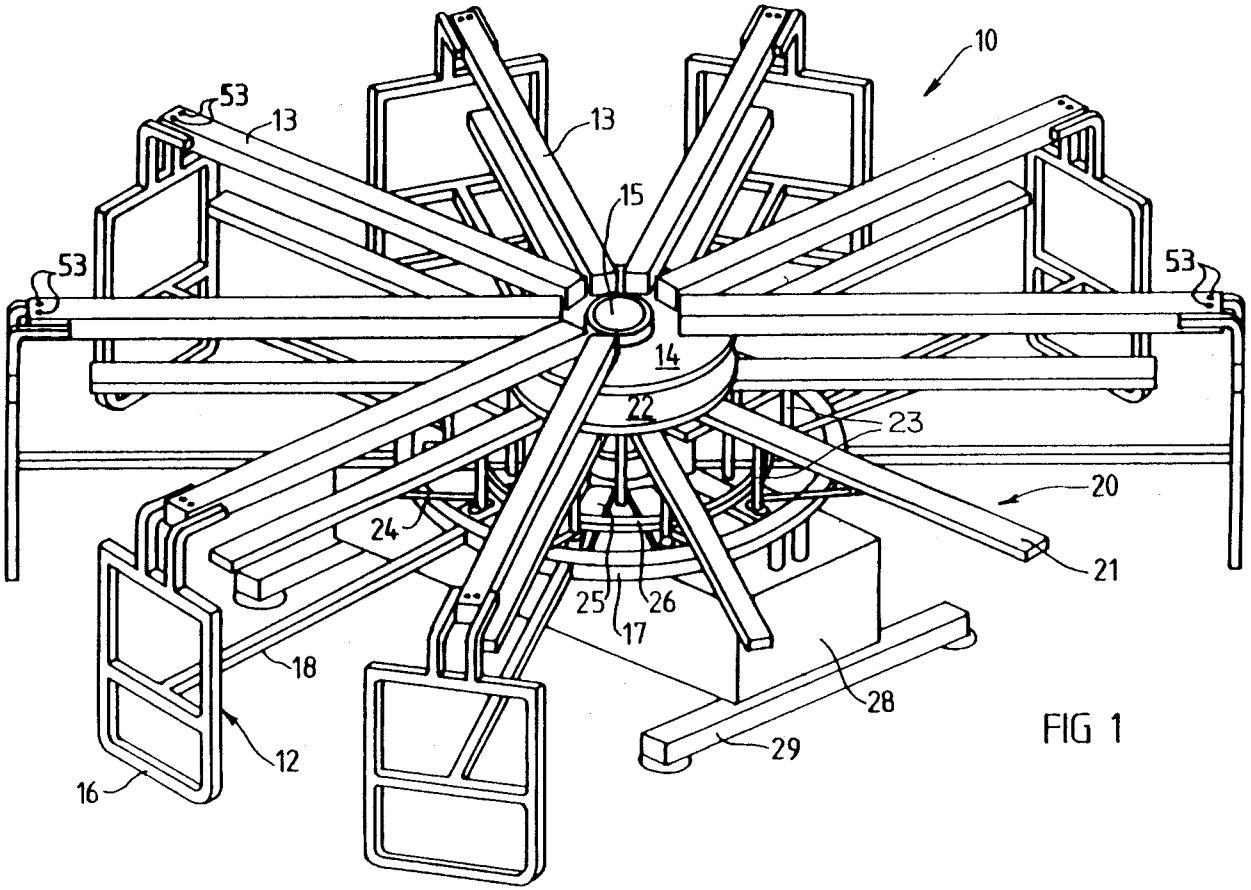
FIG. 1 is a perspective view of a screen printing machine illustrating the general features of the machine.

The screen printing machine 10 shown in FIG. 1 includes a fixed frame 12 and a rotatable frame 20. Fixed frame 12 has multiple arms 13 that project radially from a central disk 14 which is secured to an upstanding post or column 15. At their outer ends, arms 13 may be supported on rectangular frame stands 16 which are themselves braced from fixed angle section ring 17 by respective radial struts 18.

The movable frame 20 likewise comprises of multiple radially projecting arms 21 fixed to a second disk 22 which forms part of a structure rotatable on post 15. Arms 21 extend in cantilever fashion and are braced by respective uprights 23 and adjustable diagonal struts 24 to underlying plates 25 which form a further part of the rotatable structure and are themselves rigidified by an inner angle section ring 26.

Post 15 is supported on broad pedestal box 28 that itself rests upon spaced elongate stabilizing feet 29. In a complete installation, arms 13 carry respective print heads and the arms 21 support platens for the substrate to be printed. The movable frame is axially movable to that the arms 21 come into close proximity with arms 13 to effect a print operation.

Box pedestal 28 may be arranged to house a rotary indexing mechanism for rotating moving frame 20 about post 15. An example of a suitable rotary indexing mechanism is described in International patent application PCT/AU88/00232. Arms 21 are equiangularly spaced by an angle equal to the angular spacing of arms 13. It will be seen that two of the arms 12 are missing and it is in this gap that the material or substrate to be printed is positioned on the printing platens on the cantilever arms and retrieved therefrom after having executed a complete circuit.

Each screen must stop at each station defined by arms 12 whereupon the movable frame is raised towards the arms of the fixed frame so that a printing operation can be effected.

Figure 2:
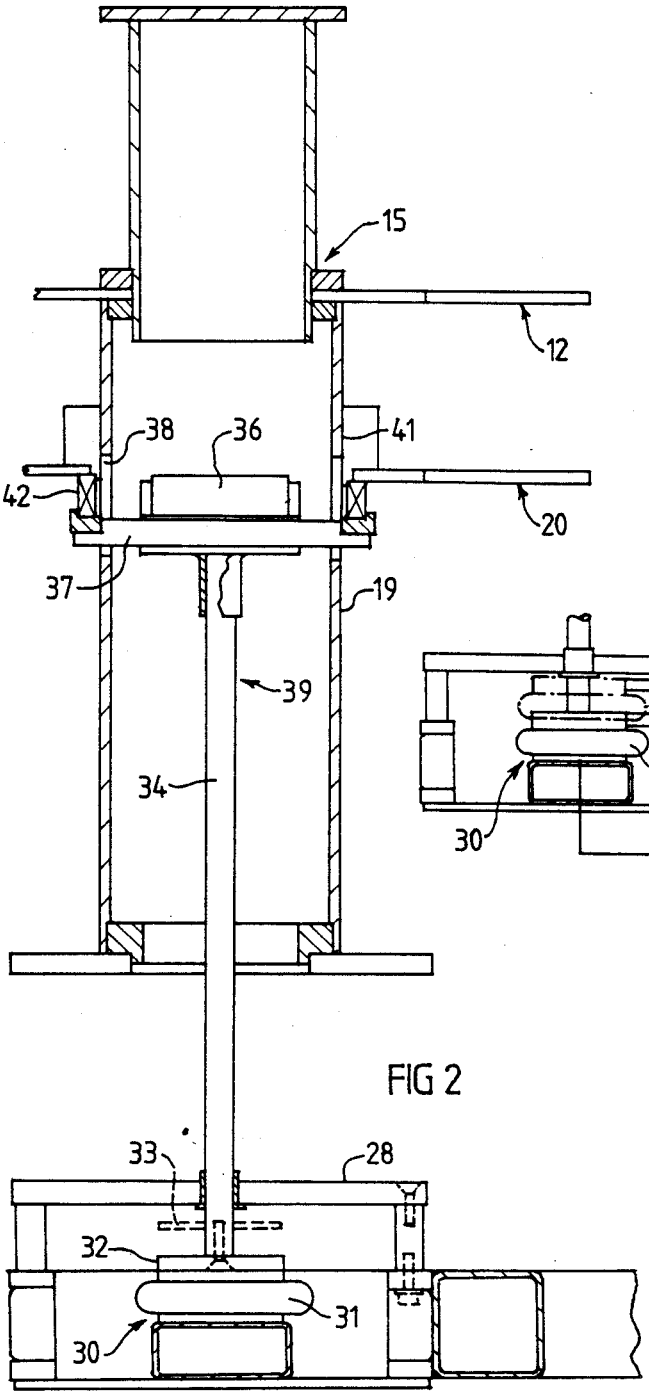
FIG. 2 is a schematic cross-sectional view of part of a screen printing machine in accordance with one aspect of the invention.
Figure 4:
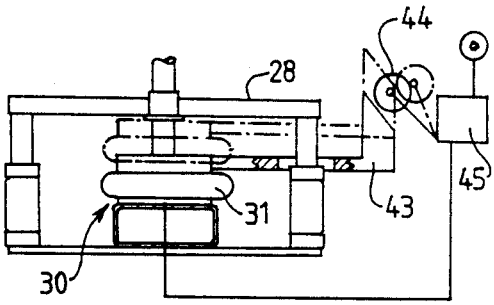
FIG. 4 is a view approximately corresponding to part of the machine shown in FIG. 2 showing a control mechanism for use with the machine.

FIGS. 2 and 4 illustrate arrangements by which the movable frame is axially movable. As shown there is provided drive means 30 in the form of an air bag 31 which can be inflated with compressed air and also allowed to deflate. The bag 31 is disposed within box pedestal 28 and is axially aligned with post 15. A plate 32 bears on the bag and is lifted thereby upon inflation. Stop 33 is provided to limit the lifting of plate 32.

Figure 3:
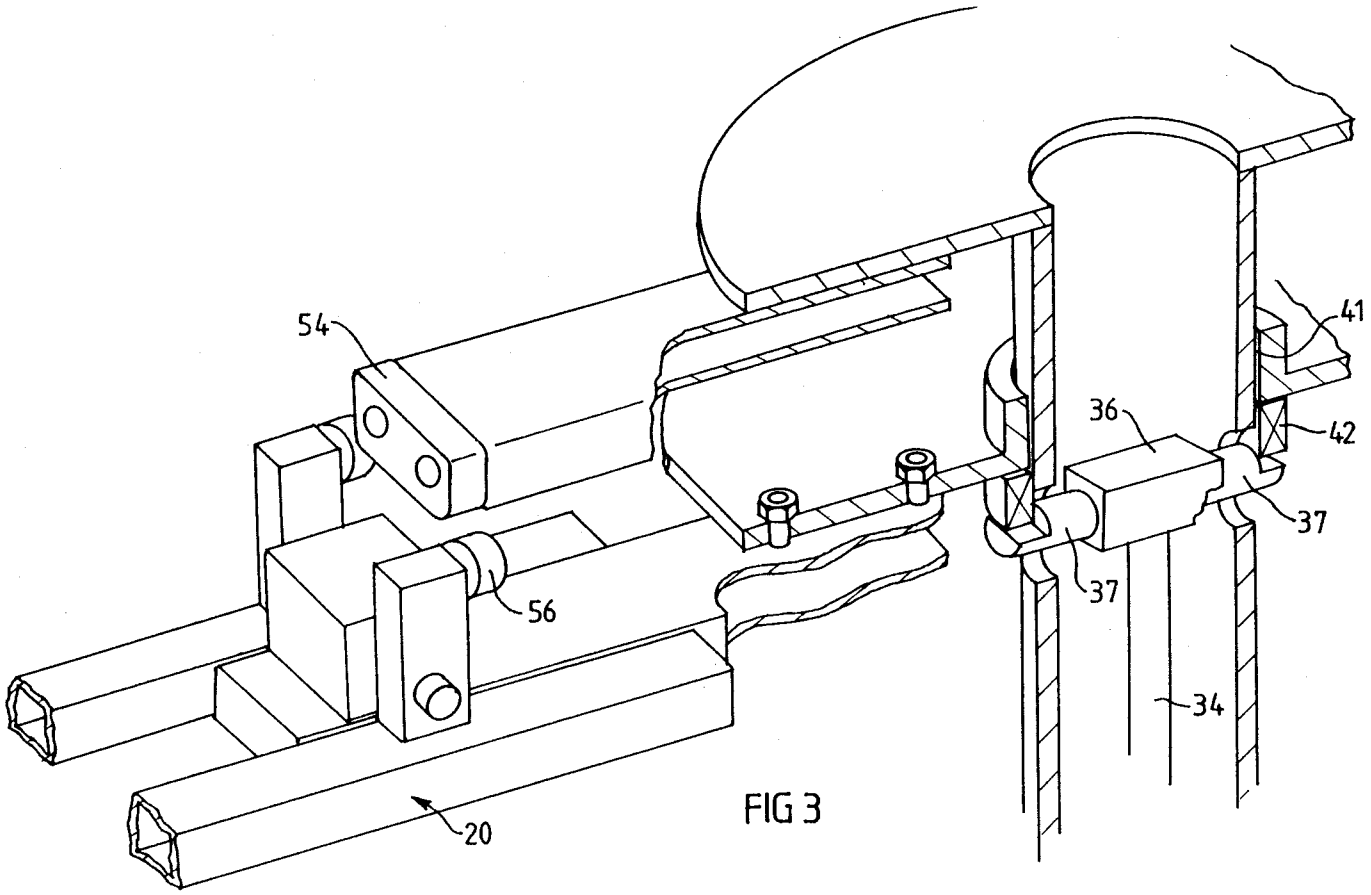
FIG. 3 is a schematic partly sectional view of part of a screen printing machine according to the invention.

Transmission means 39 operatively connects bag 31 to the movable frame 20. The transmission means 39 comprises a vertically disposed connecting rod 34 which extends from the bag 31 upwardly into a hollow portion 19 of post or column 15. At the end of connecting rod 34 there is a mounting head 36 which receives a support member 37 which has sections which extend through slots or apertures 38 in the cylindrical portion 19 of post 15. This is best seen in FIG. 3. The support member 37 has support sections thereon which are adapted to carry a thrust bearing 42. A further bearing 41 permits rotation and vertical sliding of the movable frame 20 on post 15. It will be readily apparent that by inflating and deflating bag 31 that the movable frame 20 can be raised and lowered.

As shown in FIG. 4, the plate 32 is connected to an arm 43 which on lifting of the plate 32 engages a shutoff arm 44 of an air valve 45 for supplying air to the bag 31. Thus in use the lifting should come to a smooth stop.

In an alternative construction the air bag 31 may be replaced by a pneumatic or hydraulic ram. In another alternative, a pneumatic or hydraulic ram may be located above the frame 20 from above rather than from beneath as shown in FGIS. 2 and 3.

Figure 5:
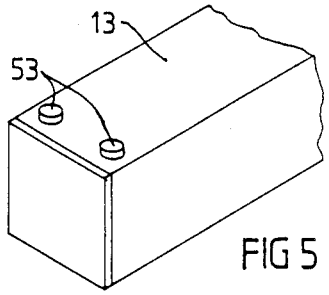
FIG. 5 is a schematic perspective view of an end of one of the arms of the screen printing machine shown in FIG. 1.

Operation of the drive means 30 is usually part of an automatic cycle can also be through push buttons 53 mounted conveniently at the free ends of the arms of the fixed frame 12. (FIGS. 1 and 5) This manual override provides a most advantageous arrangement where for example one of the printing operations at one of the stations has to be repeated.

Figure 7:
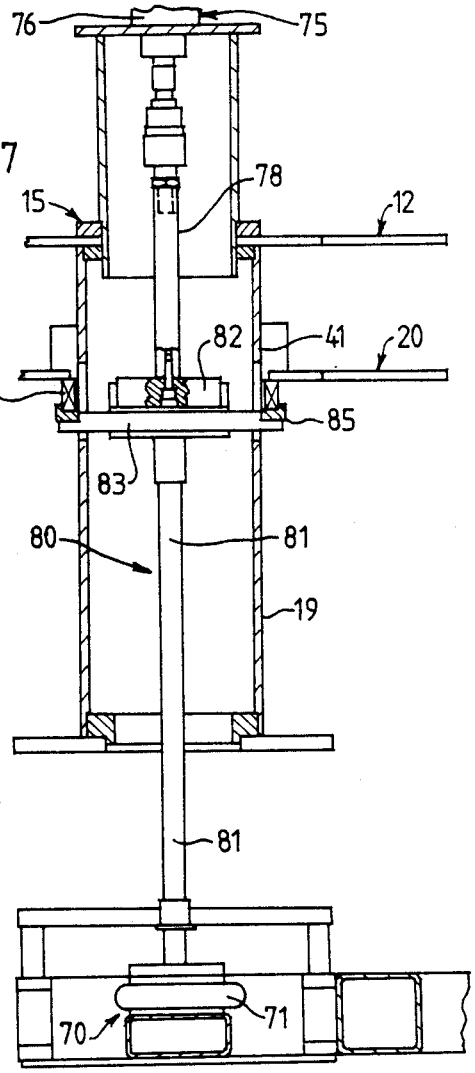
FIG. 7 is a schematic sectional side elevation of screen printing machine according to another aspect of the invention incorporating a counter balancing means.
Figure 8:
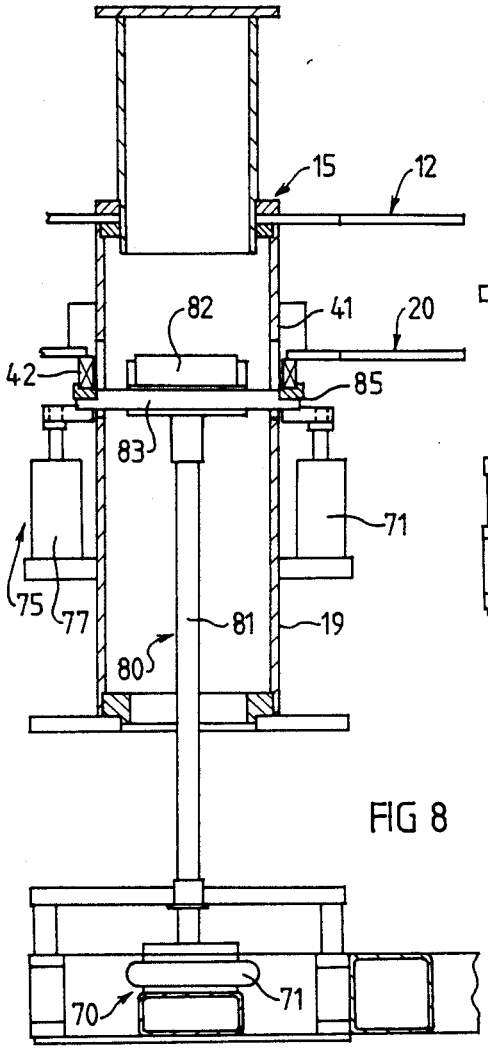
FIG. 8 is a sectional side elevation of a screen printing machine showing a variation on the embodiment shown in FIG. 7.

According to another aspect of the present invention, a counter balancing mechanism is provided to assist in the axial movement of the movable frame. This arrangement is shown in FIGS. 7 and 8. As shown, the counter balancing means 70 is comprised by an air bag 71 operatively connected to the drive means 75 by way of transmission mechanism 80. The transmission mechanism 80 is in essence the same as that described earlier and includes a connecting rod 81, mounting head 82, support member 83 having support sections 85 for carrying a thrust bearing 42.

In FIG. 7 the drive means 75 comprises a pneumatic piston/cylinder assembly 76 operatively connected to mounting head 82 via coupling member 78. As shown, the major part of the transmission between drive means 75 and counter balancing means 70 is disposed within hollow cylindrical portion 19 of post 15.

The counter balancing air bag 71 is arranged so as to provide a substantially constant counter balancing force to the weight (or at least part of the weight) of the movable frame. For example, the air bag 71 may be connected to a pressurized fluid source via a pressure regulator which can maintain the pressure within the bag substantially constant. In another arrangement, it may be possible to connect the bags 71 to a reservoir of much larger volume or of sufficient volume that the pressure in the bag remains substantially unchanged.

In the various embodiments descibed there may be provided primary stop means 90 which prevents the movable frame 20 from being raised unless it is correctly registered with the fixed frame 12. That is unless the arms of the movable frame are correctly aligned with those of the fixed frame the arms will contact the stop means 90 to prevent the movable frame from being raised. Two embodiments of stop means 90 are shown in FIGS. 6 and 9.

Figure 6:
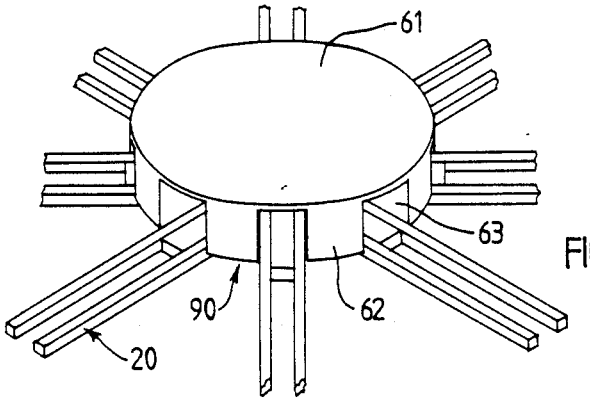
FIG. 6 is a schematic perspective view of part of a a screen printing machine in accordance with this invention.

As shown in FIG. 6 the stop means 90 comprises a perimetric skirt 62 which forms part of the top 61 of the fixed frame. It will be noted in this schematic drawing the arms of the fixed frame are not shown. The skirt 62 has a series of slots 63 therein along which the arms of the movable frame 20 can travel when correctly or near correctly registered with respect to the arms of the fixed frame 12. When the movable frame is in its lower position the arms are disposed below the skirt 62 and thus the movable frame 20 is free to rotate. Should for some reason the arms of the movable frame come to rest in a position where they are not in alignment with the arms of the fixed frame, the arms of the movable frame will engage skirt 62 upon lifting and prevent the movable frame being raised further.

Figure 9:
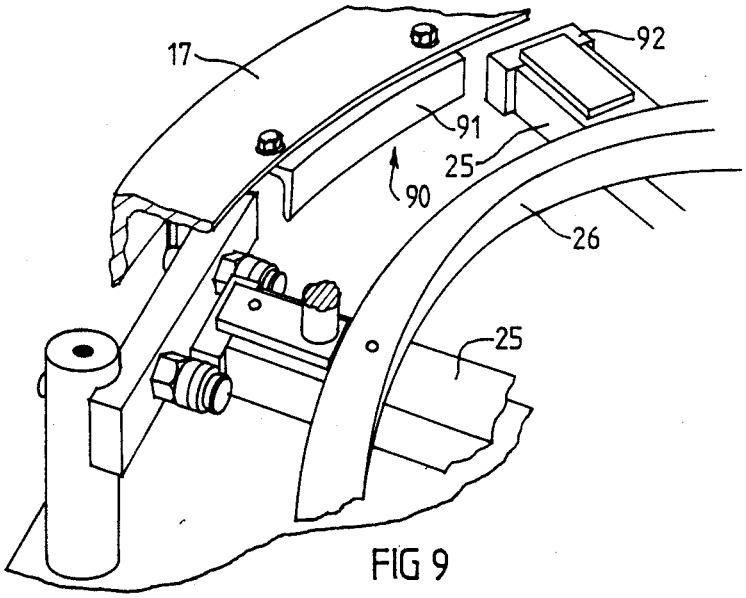
FIG. 9 is a schematic view part of a screen printing machine according to the present invention.

In the embodiment shown in FIG. 9, the primary stop means 90 comprises series of circumferentially spaced stop bars 91 which are mounted to ring 17 of the fixed frame. These bars 91 are engaged by register arms or plates 25 on the movable frame if these arms (and therefore the main arms) are not correctly positioned.

Figure 11:
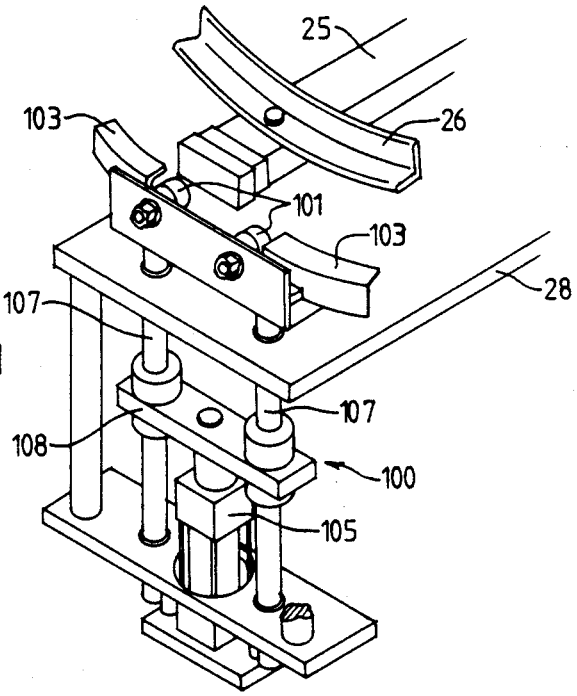
FIG. 11 is a schematic perspective view of the preliminary locating means shown in FIG. 10.
Figure 10:
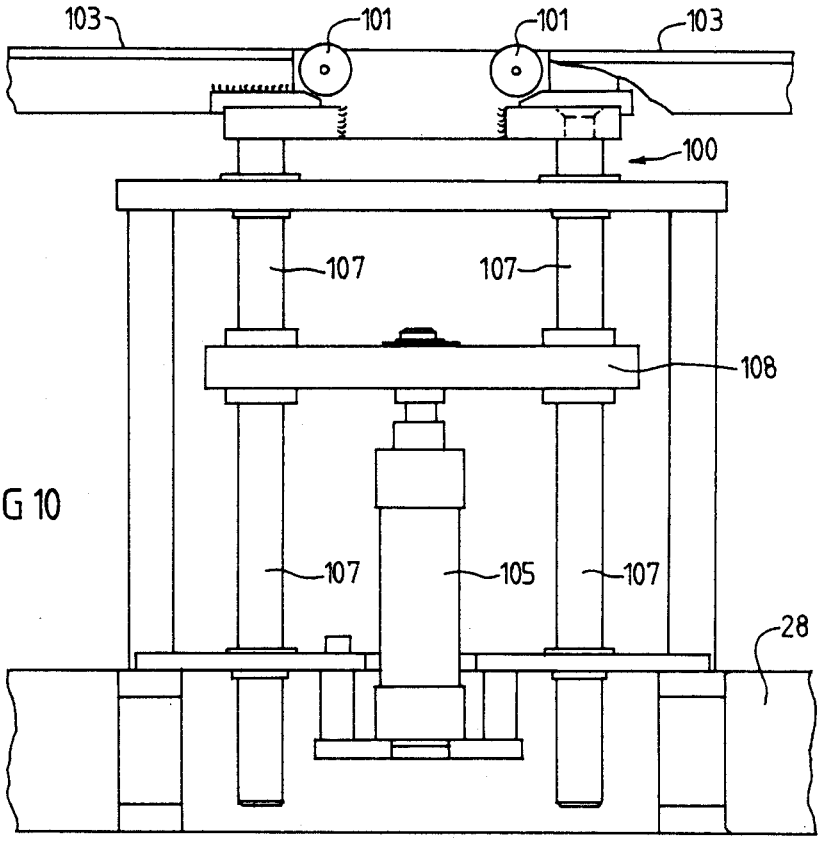
FIG. 10 is a schematic side elevation of preliminary location means for a screen printing machine according to another aspect of the invention.

FIGS. 10 and 11 relate to a preliminary locating device 100 which brings the fixed and movable frames into correct register position prior to the movable frame being raised. The preliminary locating means comprises a movable member which is actuatable by actuation of the drive member 30 or 75 for causing axial movement of the movable frame, this movable member being operable to commence moving before the drive member commences to move and being adapted to engage a locating member 25 on the other parts so as to correctly align the two parts together.

The movable member 100 includes a pair of spaced apart rollers 101 operatively connected to a pneumatic piston/cylinder assembly 105 which is operatively connected to the fixed frame or a fixed support, the rollers 105 being adapted to locate within an alignment block 25 on the movable frame. Piston/cylinder assembly 105 is connected to bridge 108 and raises rods 107. Crash bars 103 are disposed on both sides of the rollers 101 and stop operation if the device is too far out of alignment. The pneumatic piston/cylinder assembly 105 is operatively connected to the same power source as the drive means but is smaller in size so that it will activate more quickly.

Thus in operation when one of the movable arms 21 is positioned correctly relative to one of the fixed arms 12 at one of the operating positions, the pneumatic power source which moves the movable frame axially is activated. Because assembly 105 is smaller than the assembly used to move the frame it is activated first and member 100 is moved so as to correctly locate the two frames with respect to one another.

The frame 20 then commences to lift with the arms of the two frames being held by member 100. After frame 20 has moved a selected axial distance a further registration device may come into effect. Such device is shown in FIG. 3 and comprises a pair of rollers 56 mounted to frame 20 engageable with block 54 operatively connected to the fixed frame 12.

Finally, it is to be understood that various alterations, modifications and or additions may be incorporated into the various constructions and arrangements of parts without departing from the spirit and ambit of the invention.

I claim:

1. A screen printing machine comprising (i) an upright post having a longitudinal axis;

(ii) a fixed frame which is fixed relative to said post, said fixed frame including a plurality of arms which extend generally radially with respect to the longitudinal axis of said post;

(iii) a movable frame mounted for rotational movement about the longitudinal axis of the post and for axial movement in the direction of the longitudinal axis of said post between a print position and a non-print position;

(iv) counter balancing means operatively connected to the movable frame and being arranged to provide a counter balancing force to at least part of the weight of the movable frame during said axial movement thereof, said counter balancing means being adapted to maintain a substantially constant counter balancing force during said axial movement of said movable frame; and (v) drive means for causing said axial movement of said movable frame.

2. A screen printing machine according to claim 1 wherein said counter balancing means surprises an air bag operatively connected to said movable frame and being adapted to be inflated or deflated to control the counter balancing force on the movable frame section.

3. A screen printing machine according to claim 2 wherein said post includes a hollow generally cylindrical portion, said air bag being operatively connected to said movable frame by transmission means, said transmission means including a connecting rod operatively connected to said air bag and at least partially disposed within said hollow portion of said post said connecting rod extending generally in the direction of the longitudinal axis of the post, and a support member having support arms which extend generally laterally with respect to the longitudinal axis of said post, said arms extending through openings in the wall of the hollow portion of the post said arms having support sections operatively connected to said movable frame.

4. A screen printing machine according to claim 3 wherein said drive means comprises a pneumatic piston/cylinder assembly at least partially disposed within said hollow portion of said post and operatively connected to said transmission means.

5. A screen printing machine according to claim 3 wherein said drive means comprises a pair of pneumatic piston/cylinder assemblies operatively connected to said movable frame, said piston/cylinder assemblies being disposed externally of said post.

6. A screen printing machine according to claim 3 wherein said support sections of said arms are adapted to engage a thrust bearing arranged to support said movable frame.

7. A screen printing machine according to claim 1 wherein said movable frame is rotatable through a plurality of register positions in which the movable frame arms are disposed relative to the fixed frame arms such that a printing operation can be effected by axial movement of the movable frame to said print position, the screen printing machine further including primary stop means for inhibiting axial movement of the movable frame unless it is in one of said register positions.

8. A screen printing machine according to claim 7 further including preliminary locating means operable to locate the frames relative to one another prior to axial movement of the movable frame.

9. A screen printing machine according to claim 7 further including preliminary locating means operable to locate the frames relative to one another prior to axial movement of the movable frame.

10. A screen printing machine comprising (i) an upright post having a longitudinal axis, and a hollow generally cylindrical portion;

(ii) a fixed frame which is fixed relative to said post, said fixed frame including a plurality of arms which extend generally radially with respect to the longitudinal axis of said post;

(iii) a movable frame mounted for rotational movement about the longitudinal axis of the post and for axial movement in the direction of the longitudinal axis of said post between a print position and a non-print position;

(iv) drive means for causing said axial movement of said movable frame;

(v) transmission means operatively connecting said drive means to said movable frame said transmission means including a connecting rod operatively connected to said drive means and at least partially disposed within said hollow portion of said post said connecting rod extending generally in the direction of the longitudinal axis of the post, and a support member having support arms which extend generally laterally with respect to the longitudinal axis of the post, said arms extending through openings in the was of the hollow portion of the said arms having support sections operatively connected to said movable frame.

11. A screen printing machine according to claim 10 wherein said drive means comprises a pneumatic piston/cylinder assembly at least partially disposed within said hollow portion of said post and operatively connected to said transmission means.

12. A screen printing machine according to claim 11 wherein said support sections of said arms are adapted to engage a thrust bearing arranged to support said movable frame.

13. A screen printing machine according to claim 10 wherein said movable frame is rotatable through a plurality of register positions in which the movable frame arms are disposed relative to the fixed frame arms such that a printing operation can be effected by axial movement of the movable frame to said print position, the screen printing machine further including primary stop means for inhibiting axial movement of the movable frame unless it is in one of said register positions.

14. A screen printing machine according to claim 10 wherein said drive means comprises an air bag operatively connected to said movable frame and being adapted to be inflated or deflated to cause the axial movement of the movable frame section.

15. A screen printing machine comprising (i) an upright post having a longitudinal axis;

(ii) a fixed frame which is fixed relative to said post, said fixed frame including a plurality of arms which extend generally radially with respect to the longitudinal axis of said post; and (iii) a movable frame mounted for rotational movement about the longitudinal axis of the post and for axial movement in the direction of the longitudinal axis of said post between a print position and non-print position;

(iv) said movable frame being rotatable through a plurality of register positions in which the movable frame arms are disposed relative to the fixed frame arms such that a printing operation can be effected by axial movement of the movable frame to said print position, the screen printing machine further including preliminary locating means operable to locate the frames relative to one another prior to axial movement of the movable frame wherein said preliminary locating means comprises a movable member having spaced apart rollers thereon operatively connected to a linear actuator fixedly mounted relative to the movable frame, and an alignment block on said movable frame capable of being received between said pair of rollers.

* * * * *